United States Patent [19]

Monfredi

[11] Patent Number: 4,588,064

[45] Date of Patent: May 13, 1986

[54] COIN SLIDE BRACKET AND FLANGE ADAPTER FOR A VENDING MACHINE

[75] Inventor: Jim M. Monfredi, Los Angeles, Calif.

[73] Assignee: PWS Company, Los Angeles, Calif.

[21] Appl. No.: 666,333

[22] Filed: Oct. 30, 1984

[51] Int. Cl.[4] ..... G07F 5/04

[52] U.S. Cl. ..... 194/238; 194/343

[58] Field of Search ..... 194/1 G, 1 E, 92, 93, 194/9 R, 9 T

[56] References Cited

U.S. PATENT DOCUMENTS 3,111,213 11/1963 Hall ..... 194/1 E

*Primary Examiner*—Stanley H. Tollberg

*Attorney, Agent, or Firm*—Gene W. Arant; Paul H. Ware

[57] ABSTRACT

A coin slide mechanism adapter plate attachable to the coin slide mechanism of a vending machine such as may be used for automatic washing and drying machines or the like installed in apartment or other multiple dwelling complexes, forms a mechanical interface for mating the coin slide mechanism to the vending machine and includes a vending machine attachment bracket for supporting a start switch housing that contains a start switch and its activating member to initiate operation of the mechanism controlled by insertion of the correct coins in and operation of the coin slide mechanism.

1 Claim, 8 Drawing Figures

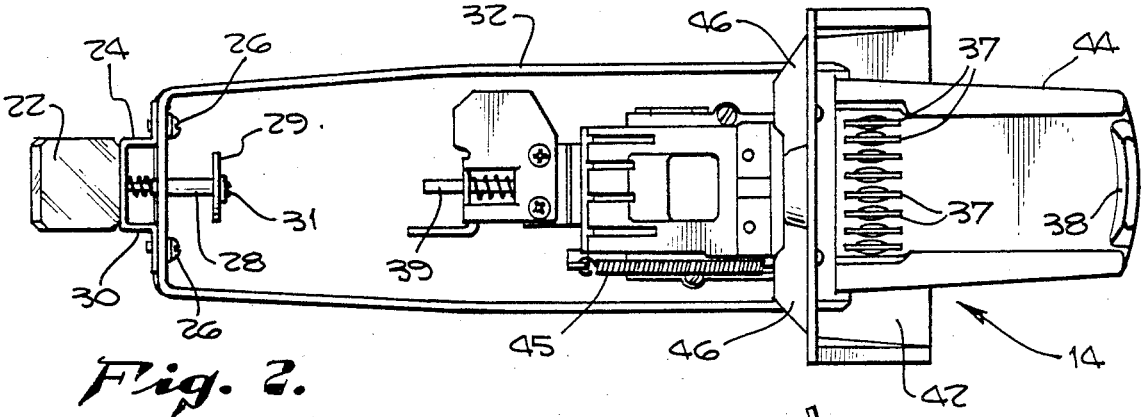
Fig. 2.
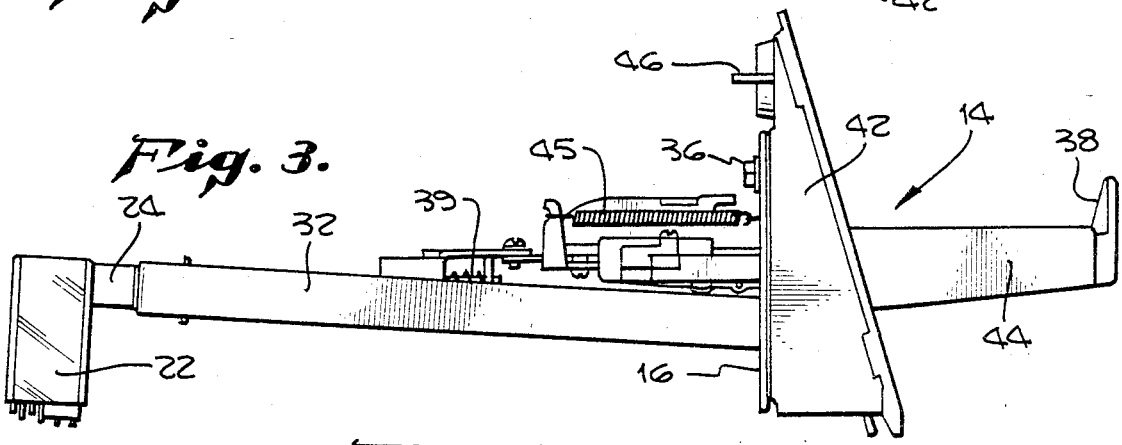
Fig. 3.
Fig. 4.
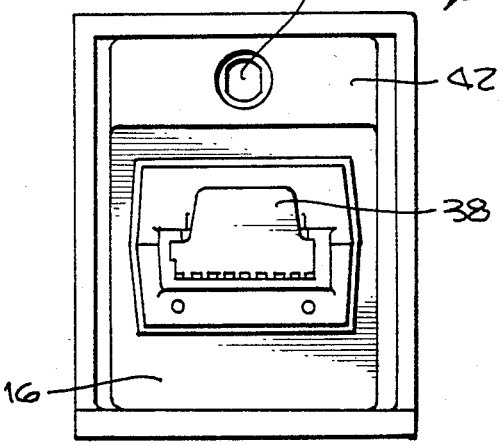
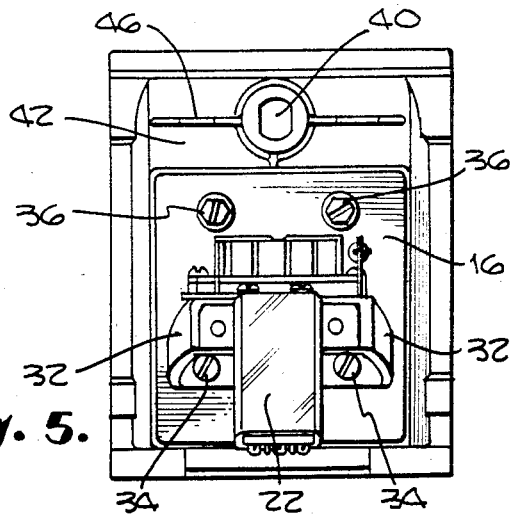
Fig. 5.
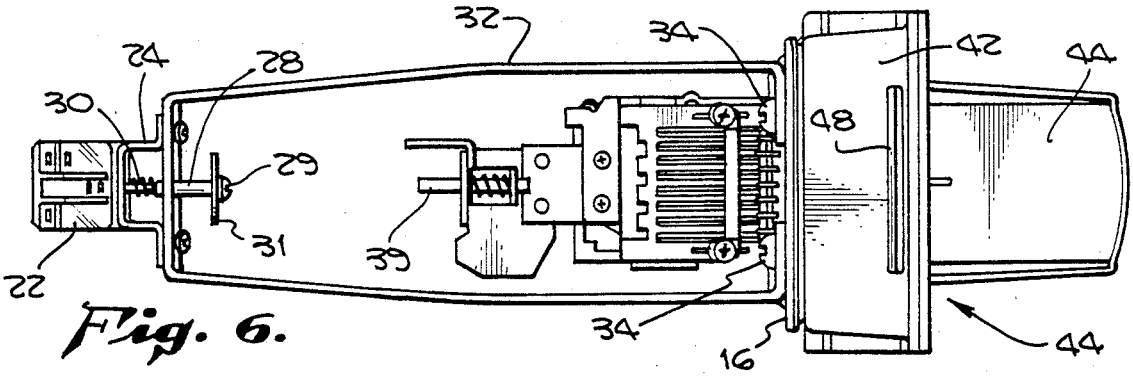
Fig. 6.

COIN SLIDE BRACKET AND FLANGE ADAPTER FOR A VENDING MACHINE

BACKGROUND OF THE INVENTION

1. Field of the Invention

This invention relates generally to coin slides for automatic vending machines and more particularly to adapting means forming mating interfaces between said machines and said coin slides.

Many types of coin slides have been used in the operation of automatic vending machines. In the fitting of a particular coin slide to a vending machine, it has often been found that an interface must be interposed between the coin slide and the machine.

It would thus be a great advantage to provide an adapter that will furnish a mechanical interface between a coin slide mechanism and an automatic vending machine.

A further advantage would be realized by the provision of supporting means incorporated into said adapter for a start switch for the vending machine and activation means therefor.

SUMMARY OF THE INVENTION

It is therefore an object of the present invention to provide an adapter to mate a coin slide mechanism to an automatic vending machine.

A further object of the present invention is to provide a bracket to support a start switch for the vending machine and the activating mechanism therefor.

In the accomplishment of these and other objects a coin slide mechanism adapter plate and a coin slide mechanism adapter bracket are provided that form a mechanical interface between a vending machine and a coin slide mechanism and also provide for the start up of the vending machine through the operation of the coin slide mechanism.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which:

FIG. 2 is a top plan view of a coin slide mechanism showing the attachment of a coin slide mechanism adapter bracket.

FIG. 3 is a side elevational view of the device shown in FIG. 2.

FIG. 4 is a front elevation of the coin slide mechanism showing the vending machine attachment bracket and the aperture thereof for securing to the vending machine.

FIG. 5 is a rear elevation of the coin slide mechanism showing the start switch housing and the attachment means for the coin slide mechanism adapter plate and the coin slide mechanism adapter bracket.

FIG. 6 is a bottom view of the device.

DETAILED DESCRIPTION

Although a specific embodiment of the invention will now be described with reference to the drawings, it should be understood that such embodiments are by way of example only and merely illustrative of but a small number of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
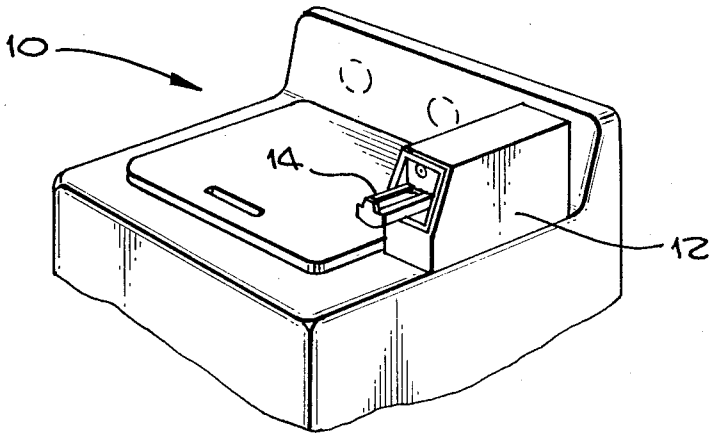
FIG. 1 is a fragmented perspective view of a coin slide mechanism mounted on an automatic service vending machine

Referring to FIG. 1 with greater particularity, there is shown a vending machine 10 having attached to it a coin slide support 12 which incorporates a coin slide mechanism 14. The coin slide mechanism 14 and its mounting are of particular interest in explaining the operation of the present invention. The start switch that initiates the operation of the vending machine has not been shown, however, such switches are old in the art and need not be examined here.

Referring now to FIGS. 2, 3, and 6, we have a top plan view in FIG. 2 of the coin slide mechanism 14 showing the coin slide handle 38 and the coin slide housing 44 in relation to vending machine attachment bracket 42. The vertical coin receiving slots 37 are indicative of the mechanism described in U.S. Pat. No. 4,350,240 for COIN SLIDE WITH INTERCHANGEABLE CORES to Gitlin et al. The mechanism chosen to illustrate the present invention is merely illustrative and is not intended to limit the invention to specific application thereof. The mechanism of the coin slide is shown to the left of the top flange 46 of the vending machine attachment bracket 42. The coin slide return spring 45 operates to return the coin slide mechanism to its normal position after insertion of the correct coins and release of handle 38.

Coin slide mechanism adapter bracket 32 supports start switch housing 22 which is attached thereto by means of start switch housing adapter bracket 24 which is in turn secured to coin slide mechanism adapter bracket 32 by means of bracket mounting bolts 26. Also secured through adapter bracket 32 is start switch actuator pin 28 having start switch actuator pin return spring 30 operable to return pin 28 to its normal position after release. Start switch actuator pin 28 carries start switch actuator plate 29 secured by means of actuator plate mounting bolt 31. Actuator pin 28 is operated by means of the action of coin slide mechanism 14 through coin slide actuator pin 39. FIG. 3 shows more clearly the coin slide mechanism adapter plate mounting bolts 36 in the implementation for securing coin slide mechanism adapter plate 16 to vending machine attachment bracket 42 and coin slide mechanism 14. In FIG. 6, a bracket bottom flange 48 of vending machine attachment bracket 42 is shown. Adapter bracket mounting bolts 34 are shown securing coin slide mechanism adapter bracket 32 to coin slide mechanism adapter plate 16, vending machine attachment bracket 42 and coin slide mechanism 14.

FIGS. 4 and 5 are respectively front and rear views of the mechanism, FIG. 4 showing the aperture 40 in the vending machine attachment bracket 42 for securing the device to the vending machine. FIG. 5 shows the coin slide mechanism adapter plate mounting bolts 36 attaching coin slide mechanism adapter plate 16 and adapter bracket mounting bolts 34 also securing coin slide mechanism adapter bracket 32 to adapter plate 16.

Figure 7:
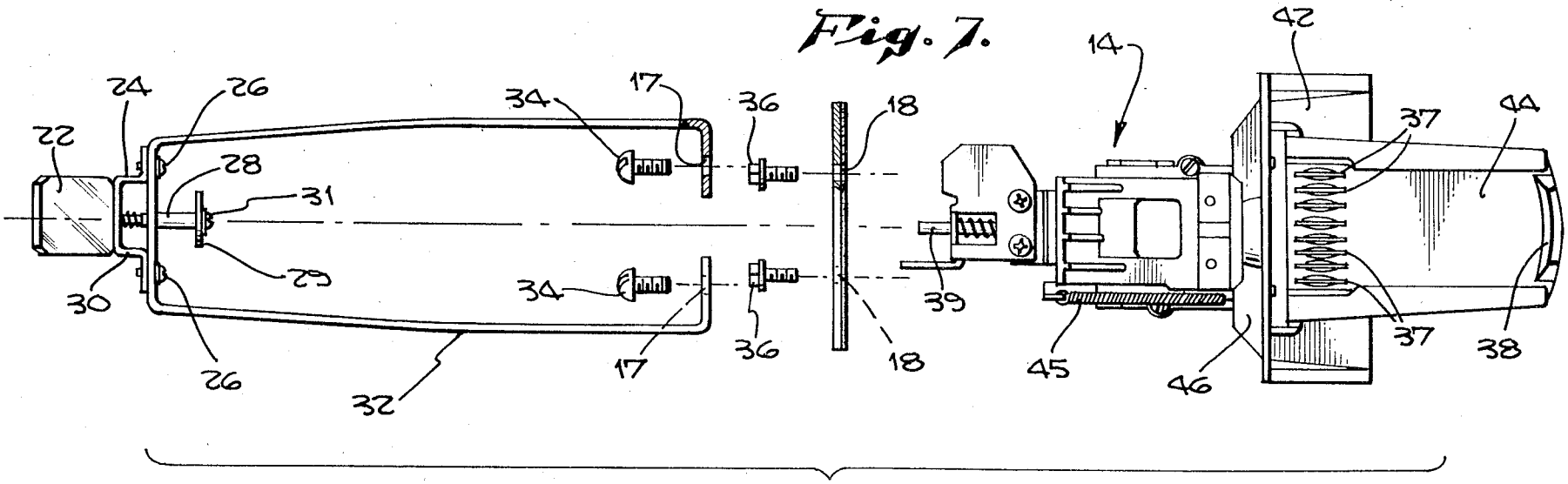
FIG. 7 is an exploded diagram showing the coin slide mechanism adapter bracket supporting the start switch housing and in position to be attached by means of coin slide mechanism adapter plate to the coin slide mechanism.

FIG. 7, the exploded view, shows the parts in relationship to each other just prior to assembly. Coin slide mechanism adapter plate mounting bolts 36 go through two plate securing apertures 18 to secure coin slide mechanism adapter plate 16 to vending machine attachment bracket 42 and coin slide mechanism 14. Adapter bracket mounting bolts 34 go through bracket securing apertures 17 in coin slide mechanism adapter bracket 32 and through two other plate securing apertures 18 in coin slide mechanism adapter plate 16 to secure coin slide mechanism adapter bracket 32 and coin slide mechanism adapter plate 16 to vending machine attachment bracket 42 and coin slide mechanism 14.

In operation, coin slide mechanism 14 will not attain its full throw when coin slide handle 38 is manually pushed in by an operator unless the required coins have been inserted in the coin receiving slots 37. In this situation, coin slide actuator pin 39 will not extend far enough to operate start switch actuator pin 28. Thus the vending machine will not start. However, upon selecting and inserting the requisite coins in receiving slots 37, the coin slide mechanism 14 will be enabled to attain its full throw whereby coin slide actuator pin 39 will mechanically engage and actuate start switch actuator pin 28 so that the vending machine will be started into operation. Upon the subsequent release of coin slide handle 38 by the operator, coin slide mechanism 14 will be returned to its normal position by the action of coin slide return spring 45 and start switch actuator pin 28 will be returned to its normal position by the action of start switch actuator pin return spring 30.

Figure 8:
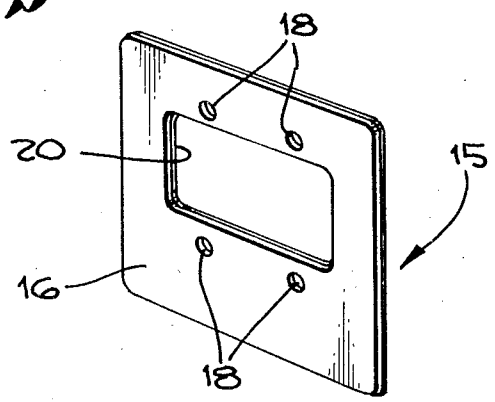
FIG. 8 is a detail drawing of the coin slide mechanism adapter plate.

FIG. 8 shows the details of the flat rectangular metal plate 15 in which is formed the coin slide mechanism adapter plate 16. The rectangular receiving aperture 20 for the coin slide mechanism is shown along with a pattern of plate securing apertures 18.

Thus, there has been described a coin slide bracket and flange adapter for a vending machine that will provide an interface between the coin slide mechanism and the vending machine and also provide support and operative mechanism for a start switch to control the starting operation of the vending machine.

It is pointed out that although the present invention has been shown and described with reference to a particular embodiment, nevertheless various changes and modifications, obvious to one skilled in the art to which the invention pertains, are deemed to lie within the purview of the invention.

I claim:

1. A coin handling assembly for insertion into a coin-operated machine, comprising, in combination;

a horizontally disposed coin slide mechanism having vertical coin slots and interchangeable cores;

a vertically disposed adapter plate and bracket assembly for attachment to a generally vertical housing of the machine, having an aperture within which said coin slide mechanism is received;

said coin slide mechansim having a movable slide and being responsive to the insertion of a predetermined set of coins to permit said slide to be manually slidably moved into the interior of the machine for depositing the coins, and having a return spring for then automatically returning said movable slide;

an adapter bracket having an open looped configuration with its open end attached to said adapter plate and bracket assembly, and its closed end extending beyond and around the space into which said slide mechanism travels;

a start switch carried by the closed end of said adapter bracket;

a start switch activator pin slidably supported by said closed end of said adapter bracket, and operable when moved toward said start switch for turning said start switch on;

a coin slide activator pin carried by the forward end of said movable slide of said coin slide mechanism for selectively engaging said start switch activator pin;

a handle on the rearward end of said movable slide;

whereby when the predetermined set of coins is inserted and said handle is pushed forward, the coins are deposited inside the machine, said coin slide activator pin engages said start switch activator pin for turning said start switch on, and said return spring then returns said movable slide to its initial position; and a second return spring associated with said start switch activator pin for returning it to its initial position.

* * * * *